US005494152A

United States Patent [19]

Sobczak et al.

[11] Patent Number: 5,494,152

[45] Date of Patent: Feb. 27, 1996

[54] DETONATOR PACKAGING SYSTEM

[75] Inventors: Brian R. Sobczak, Granby; J. Donaldson Thomas, Simsbury, both of Conn.

[73] Assignee: The Ensign-Bickford Company, Simsbury, Conn.

[21] Appl. No.: 96,905

[22] Filed: Jul. 23, 1993

[51] Int. Cl.[6] ..... F42B 39/00; F42B 3/10; B65D 81/02

[52] U.S. Cl. ..... 206/3; 102/202.12; 206/388; 206/591

[58] Field of Search ..... 53/449, 472; 102/202.12, 102/275.5; 206/593, 591, 521, 3, 388, 592, 587

[56] References Cited

U.S. PATENT DOCUMENTS

| | | | |
|---|---|---|---|
| Re. 33,446 | 11/1990 | Levey, Sr. . | |
| 1,328,524 | 1/1920 | Knapp | 206/521 X |
| 1,631,756 | 2/1925 | Olin . | |
| 1,716,628 | 6/1929 | Gittleman | 206/44.12 X |
| 2,352,998 | 7/1944 | Alexander et al. . | |
| 2,393,221 | 1/1946 | Mercer et al. . | |
| 2,601,919 | 7/1952 | Darbyshire . | |
| 2,660,300 | 11/1953 | Pauls | 206/593 X |
| 2,669,351 | 2/1954 | Carson et al. | 206/593 X |
| 2,868,360. | 1/1959 | Donkin . | |
| 3,456,783 | 7/1969 | Clark | 206/593 X |
| 3,590,739 | 7/1971 | Persson | 102/275.5 |
| 3,981,240 | 9/1976 | Gladden | 102/275.5 |
| 4,586,602 | 5/1986 | Levey . | |
| 4,817,787 | 4/1989 | Owen . | |
| 4,895,249 | 1/1990 | Davis et al. . | |
| 5,005,694 | 4/1991 | Davis et al. . | |
| 5,007,230 | 4/1991 | Gaston . | |
| 5,127,593 | 7/1992 | Gaston . | |
| 5,129,514 | 7/1992 | Lilley, Jr. . | |
| 5,160,023 | 11/1992 | Adams et al. . | |

*Primary Examiner*—Bryon P. Gehman
*Attorney, Agent, or Firm*—Victor E. Libert; Frederick A. Spaeth

[57] ABSTRACT

A packaging system for storing and transporting detonating devices includes a plurality of subpack containers (12) disposed in an overpack container (24), the subpack containers being dimensioned and configured to contain therein a plurality of unsegregated detonating devices, and an overpack pad (26*a*) disposed in the overpack container between adjacent subpack containers. Alternatively, the system comprises at least one subpack assembly (10) including a subpack container having disposed therein a divider (14,16) defining a plurality of compartments in the subpack container, each compartment being sized to contain a plurality of unsegregated detonating devices. There is a subpack pad (18) disposed between adjacent compartments in each subpack container to limit the propagation of the detonation of one or more detonating devices and an overpack container (24) within which is disposed at least one subpack container.

9 Claims, 4 Drawing Sheets

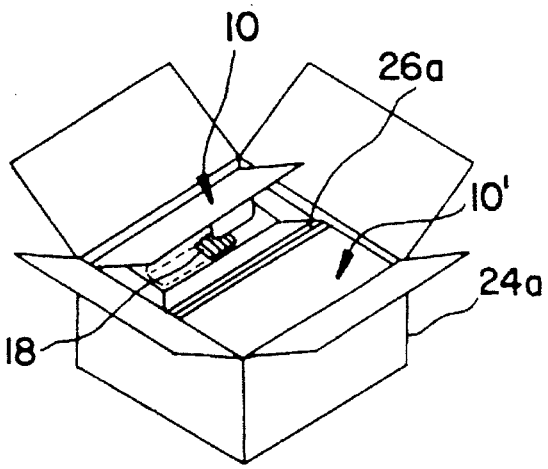
FIG. 2
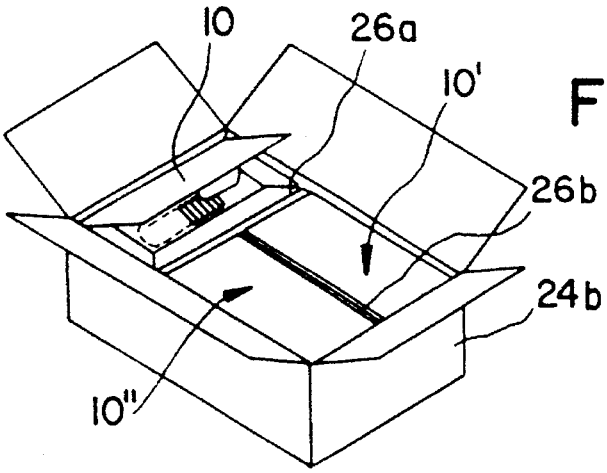
FIG. 3A
FIG. 3B
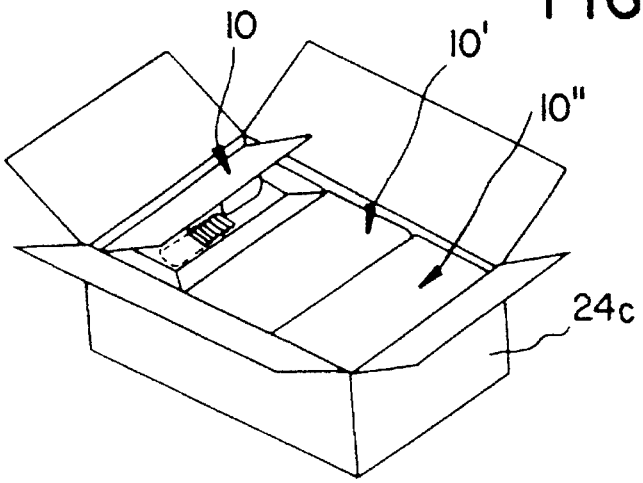

(COMPARATIVE EXAMPLE)

DETONATOR PACKAGING SYSTEM

BACKGROUND OF THE INVENTION

1. Field of the Invention

This invention relates to packaging systems and more particularly to systems for packaging and shipping detonators.

The need to transport commercial quantities of detonating devices gives rise to concerns regarding the safety with which packages containing the detonating devices can be stored and moved, because the packages may be exposed to a wide range of temperatures and may be subjected to a variety of physical stresses, e.g., impacts that may occur should the package be dropped. In designing a packaging system for detonators, attention must be given not only to preventing unwanted detonation of the detonators in the package during shipment and handling, but also to prevent the propagation of inadvertent detonation from one package to another. The prior art generally addresses these concerns through the use of dense packaging materials and by disposing detonators singly in isolated compartments.

2. Related Art

U.S. Pat. No. 2,868,360 to Donkin dated Jan. 13, 1959 discloses a storage container for detonators in which an outer box is divided by an interior partition into two main compartments, and wherein each compartment is divided into cells by a separator assembly. A single detonator is disposed within each cell.

U.S. Pat. No. 2,601,919 to Darbyshire dated Jul. 1, 1952 discloses a container for packaging electrical detonators comprising an outer box that holds a plurality of compartmentalized inner boxes. Each compartment is dimensioned and configured to hold a single detonator and associated leg wires.

U.S. Pat. No. 2,352,998 to Alexander et al dated Jul. 4, 1944 discloses a packaging system for electrical blasting caps and their associated leg wires in which each cap and its leg wire is disposed within a cardboard tube, and a plurality of the tubes is contained within a box.

U.S. Pat. No. 1,631,756 to Olin dated Jun. 7, 1927 discloses a tube arrangement for packaging a single detonator.

U.S. Pat. No. 4,586,602 to Levey dated May 6, 1986 shows a transport system for transporting detonating cord in which the detonating cord is looped around cardboard support members and packed in a cardboard box surrounded by cardboard baffles.

The Applicants have previously used a packaging system comprising an overpack container within which was disposed a plurality of subpack containers, each subpack container holding a plurality of unsegregated detonating devices. This package met 4 G fiberboard container requirements and was assigned a hazard classification of 1.1 B for the shipment of detonating devices containing up to about 985 mg of explosive material per unit and a total of 100 grams of explosive material per subpack container.

SUMMARY OF THE INVENTION

In accordance with the present invention there is provided a packaging system for storing and transporting detonating devices comprising the following components. A plurality of subpack containers is disposed in an overpack container, the subpack containers being dimensioned and configured to contain therein a plurality of unsegregated detonating devices. An overpack pad means is disposed in the overpack container between adjacent subpack containers.

In accordance with another aspect of the invention, a packaging system for storing and transporting detonating devices comprises the following components. At least one subpack assembly comprising a subpack container has disposed therein divider means defining a plurality of compartments in the subpack container. Each of these compartments is dimensioned and configured to contain a plurality of unsegregated detonating devices. Subpack pad means are disposed between adjacent compartments in each subpack container for inhibiting the transfer of energy generated from detonation of one or more detonating devices contained within the subpack container from one compartment to the adjacent compartment. The subpack container or containers are contained within an overpack container.

In another embodiment of the present invention, the subpack assembly and the overpack container may comprise corrugated board, e.g., 4 G corrugated board containers. In certain embodiments, the subpack container comprises corrugated board having a bursting strength of at least about 200 lbs/in$^2$, and the overpack container comprises corrugated board having a bursting strength of at least about 275 lbs/in$^2$.

Another aspect of the invention provides for a plurality of detonating devices disposed in each compartment with each detonating device individually comprising not more than about 800 mg of explosive material. In a related embodiment, each plurality of detonating devices comprises not more than about 25 grams of explosive material in each compartment.

Yet another aspect of the present invention provides that adjacent detonating devices are disposed with their respective detonator caps at respective opposite sides of the compartment within which they are disposed.

The present invention further comprises a packaging system for storing and transporting detonating devices, as follows: A plurality of subpack assemblies each comprising a subpack container comprising corrugated board having a bursting strength of at least 200 lbs/in$^2$ have disposed therein divider means comprising double-wall B- and C-flute or stronger corrugated board to define a plurality of compartments of the subpack assembly. Each compartment is dimensioned and configured to contain a plurality of unsegregated detonating devices, the subpack assembly further comprising subpack pad means comprising a double layer of double-wall B- and C-flute or stronger corrugated board and being disposed between adjacent compartments for inhibiting the transfer of energy generated by detonation of one or more detonators contained within the subpack assembly from one compartment to the adjacent compartment. The subpack assemblies are disposed within an overpack container comprising corrugated board having a bursting strength of at least 275 lbs/in$^2$.

A method aspect of the invention provides a method for packaging detonating devices comprising the following steps: (1) placing a plurality of unsegregated detonating devices in each of a plurality of subpack containers; (2) placing the subpack containers in an overpack container; (3) placing overpack pad means between adjacent subpack containers; and (4) sealing the overpack container.

Yet another method in accordance with the present invention provides a method for packaging detonating devices comprising the following steps: (1) placing a plurality of unsegregated detonating devices in each of at least two compartments of each of at least one subpack assembly, each subpack assembly comprising (a) a subpack container, (b) divider means in the subpack container defining at least two compartments in the subpack container, and (c) subpack pad means disposed between adjacent compartments for inhibiting the energy generated by detonation of one or more detonators contained within the subpack assembly from one compartment to the adjacent compartment; (2) placing each subpack assembly in an overpack container; and (3) sealing the overpack container.

Other aspects of the invention include carrying out the method aspects using the above-described packaging systems. Still other aspects of the invention are described below.

BRIEF DESCRIPTION OF THE DRAWINGS

FIG. 2 is a perspective view of one embodiment of a packaging system according to the present invention comprising two subpack assemblies in an overpack container;

FIGS. 3A and 3B are perspective views of other embodiments of a packaging system according to the present invention, each comprising three subpack assemblies;

DETAILED DESCRIPTION OF THE INVENTION

Figure 1:
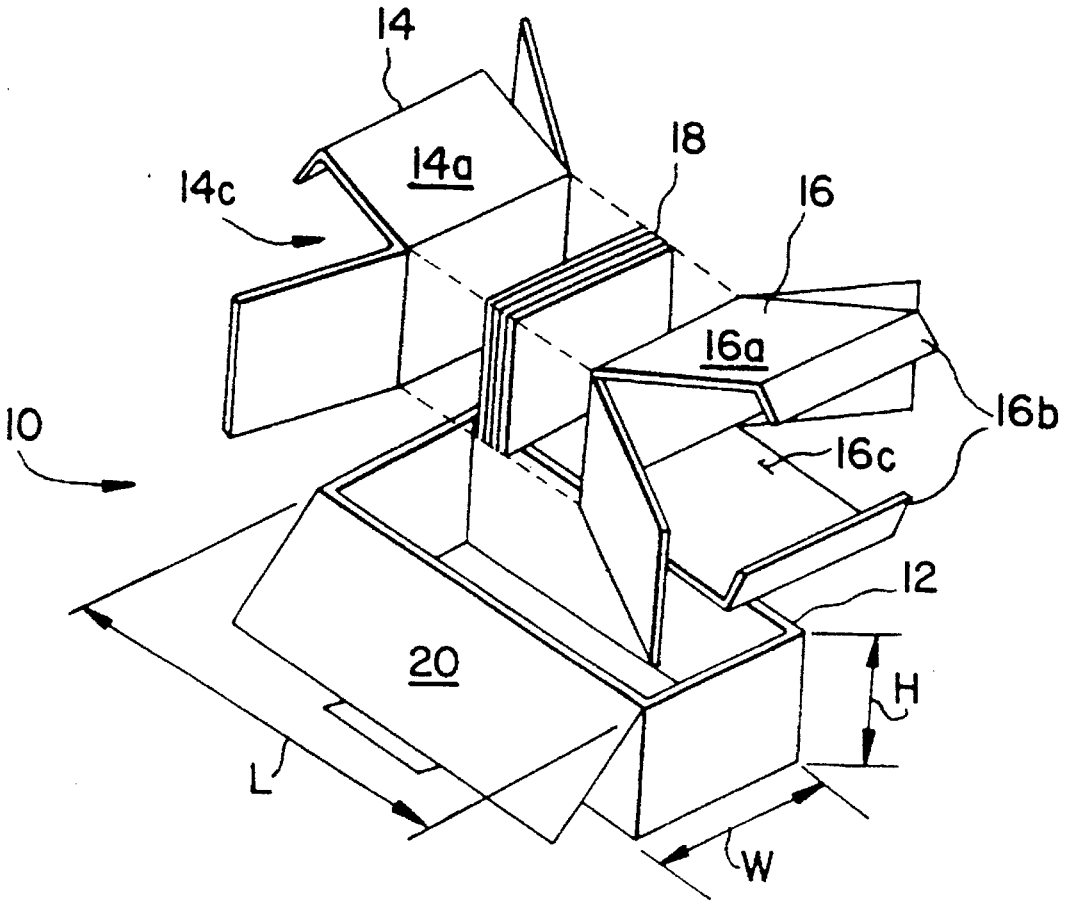
FIG. 1 is an exploded perspective view of one embodiment of a subpack assembly suitable for use in a packaging system according to the present invention.

The present invention relates to a packaging system for storing and transporting detonating devices in a manner that is inexpensive, easy to use and which meets modern safety standards prescribed by legal authorities. The level of safety provided by the present invention is reflected in its qualification under the United States Department of Transportation Classification 1.4 B set forth at 49 CFR when used to ship detonating devices as described below. Generally, this safety classification indicates that not only does the package meet the requirements of packages designated 1.1 B, indicating acceptable stability with respect to ambient temperature variations and physical impact, but the package further satisfies the requirements identified as a Series 6 Test promulgated by the United Nations and adopted by the United States Department of Transportation when used with a particular class of detonating devices as described below.

As a result of the superior safety and packaging integrity exhibited by packaging systems according to the present invention, numerous national governments will allow non-electric detonating devices for blasting operations to be shipped on the same vehicle with materials classified as 1.1 or 1.2 or 1.3, e.g., secondary blasting charges provided they are placed in an IME 22 container or other containers specified by applicable regulations. This means that when quantities allow, detonating devices and the secondary charges with which they are to be used can be transported together in a single vehicle when they otherwise may not: prior art packages rated as 1.1 B could not be shipped in this way. In addition, packages classified as 1.4 B can be shipped by means not available to those classified as 1.1 B, e.g., by cargo air. These advantages can lead to significant savings in shipping costs.

Although a variety of packaging container materials may be employed to produce a packaging system that qualifies as classification 1.4 B, the range of materials that are generally commercially acceptable for packaging systems is somewhat limited. Suitable packaging materials must pass the specified safety tests, yet must not contribute unduly to the overall weight of the package and must be easy to assemble, load and dispose of. Thus, although it may be possible to produce a packaging system for detonators that is classifiable as 1.4 B using, e.g., metal or plywood, such a packaging system may be unacceptable due to its excessive weight and difficulty in manufacture, storage prior to use and disposal thereafter.

The detonating devices contemplated for such use with the present invention generally comprise non-electric detonator caps for blasting such as those commonly used to detonate borehole explosives in blasting or mining operations. A typical detonating cap assembly is disclosed in U.S. Pat. No. 3,981,240 to Gladden, dated Sep. 21, 1976, the disclosure of which is hereby incorporated herein by reference. Typically, detonator caps comprise a metallic shell within which is disposed a charge of explosive material such as PETN. The detonator caps are conventionally attached to an ignition signal transmission line which typically comprises shock tube such as that disclosed in U.S. Pat. No. 3,590,739 to Persson dated Jul. 6, 1971, the disclosure of which is hereby incorporated herein by reference. Shock tube, as is known in the art, is an extruded tube of polymer material having a hollow core and a relatively small quantity of explosive material, e.g., HMX, disposed on the inner wall. When the explosive material at one end of the tube is ignited, an ignition pulse travels quickly along the length of the tube and can be used to initiate a detonation reaction at the other end. Due to the great speed with which the detonation signal travels, the signal is conventionally described as traveling instantaneously along the tube. However, as used herein and in the claims, "shock tube" is meant to include any suitable detonation signal transmission tube, including low velocity signal transmission tube, or the like. Often, a delay element is disposed in the cap, to cause a delay between the arrival of a signal from the shock tube and the detonation of the explosive material in the cap. A delay element typically comprises a relatively slow burning material that causes a delay of between a few milliseconds to several seconds in the transmission of the initiation signal to the explosive charge.

A package of non-electric detonators for blasting can only be accorded classification 1.4 B if, among other criteria, the explosion of any one detonator in the package will not cause the other detonators to "mass detonate", and will cause only limited propagation of the detonation. Mass detonation means that more than 90 percent of the devices in the package explode practically simultaneously, and limited propagation means that the maximum amount of explosive material that explodes upon inadvertent or spontaneous detonation does not exceed 25 grams. (See 49 CFR Section 172.101 Hazardous Materials Table for detonator assemblies, non-electric, for blasting, Identification Number UN 0361, indicating the applicability of Special Provision 103, which is set forth in Section 172.102.) To limit the propagation of inadvertent detonation, the prior art teaches that it is necessary to individually isolate each detonator from the others by disposing the detonator in an individual compartment. However, the Applicants have found that propagation of the detonation reaction in a package can be acceptably curtailed even if a plurality of detonators are disposed together in a compartment in the package. It is preferred in the practice of the present invention that the quantity of explosive material for each detonating device be not more than about 800 mg.

A packaging system according to one embodiment of the present invention comprises a subpack assembly comprising a subpack container and divider means for defining at least two compartments in the subpack container. Each compartment is dimensioned and configured to receive a plurality of unsegregated detonating devices typically comprising detonator caps and associated lengths of shock tube.

The divider means may comprise corrugated board compartment baffles or enclosures that may be folded to define a compartment. Typically, each compartment has a substantially rectangular configuration, and the enclosures establish at least five walls of their respective compartments. Optionally, the divider means may comprise compartment boxes dimensioned and configured to be disposed within the subpack container and to completely enclose the compartment on six sides. As used herein and in the claims, the term "box", when used in reference to vider means, is intended to include not only assembled and self-supporting containers but also enclosure baffles or templates which are folded into box-like configurations but which are not self-supporting.

Subpack pad means are disposed between compartments in the subpack container to provide insulation which inhibits the travel of the brisance or energy of the detonation between compartments, so that in the event of inadvertent detonation of a detonator cap in one compartment, the energy is inhibited from traveling through the divider means into the neighboring compartment in the subpack container. Thus, the subpack pad means inhibits propagation of the detonation reaction between compartments.

Since the compartment enclosures within the subpack container define at least five walls of their respective compartments, and since compartment boxes completely enclose their compartments, the subpack container and the divider means therein generally provide a double layer of corrugated board about the compartments for containing energy that may be released upon inadvertent detonation of a detonator cap therein.

The packaging system of the present invention further comprises an overpack container within which at least one, but generally a plurality, e.g., two or three, of the subpack assemblies are disposed. The overpack container provides at least an additional single layer of corrugated board to inhibit the energy released by inadvertent detonation from any subpack assembly therein to other packages. In addition, the overpack container provides an added degree of thermal insulation and physical integrity to the package. Overpack pad means disposed in the overpack container between the subpack containers to assure a tight fit of the subpack containers within the overpack container, i.e., to prevent jostling of the subpack assemblies and to provide further physical insulation against the propagation of a detonation reaction between the subpack containers by inhibiting the energy released upon detonation of a cap in the package between adjacent subpack assemblies.

Advantageously, the subpack container and overpack container of the present invention qualify as 4 G containers as described in Title 49 of the Code of Federal Regulations, Chapter 1, Section 178.516. Generally, such material must resist water at the outer surface such that an increase in mass, as determined in a test carried out over 30 minutes by the Cobb method of determining water absorption, is not greater than 155 grams per square meter. The fiberboard must be capable of creasing without cutting through the facings, and the facings must be firmly glued to the fluting. According to the present invention, a packaging system is constructed using such corrugated board material to create compartments within which pluralities of unsegregated detonating devices are disposed.

A typical subpack assembly for use in the present invention is shown in FIG. 1. Subpack assembly 10 comprises a subpack container 12, divider means provided by boxes as defined above, e.g., compartment enclosures 14 and 16 and a subpack pad means provided by subpack pad 18. Enclosures 14 and 16 which are similarly configured, are dimensioned and configured so that they can be folded from an initial flat configuration to provide panels which define compartments where detonating devices may be disposed, and are further dimensioned and configured to be simultaneously contained in the folded configuration within subpack container 12. Thus, subpack container 12 is divided into two compartments for holding detonating devices. Subpack pad 18 may be made from any suitable material such as one or more layers of corrugated board, and is preferably dimensioned and configured to engage the entire faces of the compartments between which it is disposed. Subpack pad 18 serves to inhibit the energy that may escape enclosures 14 or 16 or any alternate divider means upon detonation of a detonating device in either one of the compartments into the other compartment. Enclosures 14 and 16 are further dimensioned and configured so that respective top panels **14*a* and 16*a* can be raised while enclosures 14 and 16 are disposed within subpack container 12, to allow the user to assemble the subpack assembly and then dispose detonating devices in the compartments. When the desired quantity of detonating devices has been packed into the respective compartments, panels 14*a* and 16*a* are folded down so that subpack lid 20 can be folded over to close subpack container 12. Preferably, as shown in FIG. 1, each compartment enclosure 14 and 16 provides panels that define at least five walls of a rectangular compartment. A sixth wall may also be defined by enclosures 14 and 16, or at least partially defined, as by partial panels 16*b*, which at least partially define a sixth wall of the rectangular compartment 16*c***. As discussed below, the open, or partially open, sixth wall should be disposed at an end of the subpack container.

In accordance with the present invention, one or more subpack assemblies is disposed within an overpack container. Thus, FIG. 2 illustrates a packaging system according to the present invention in which two substantially identical subpack assemblies 10 and 10' each having therein two compartments, are disposed within an overpack container **24*a*. Like subpack assemblies 10 and 10', overpack container 24*a*** may be made from a suitable corrugated board material.

In other embodiments, such as shown in FIGS. 3A and 3B, the overpack container may be dimensioned and configured to hold three subpack assemblies. Thus, an overpack container such as **24*b* may be dimensioned and configured to hold three subpack assemblies 10, 10' and 10" in a "π" configuration, i.e., with two subpack assemblies 10' and 10" side by side and the third subpack container 10 disposed crosswise at the ends of the side by side containers as shown in FIG. 3A, or to hold all three subpack assemblies in parallel, side by side relation as overpack container 24*c*** shown in FIG. 3B. With the subpack assembly disposed within the overpack container, the overpack container provides at least one additional layer of corrugated board about the compartments where the detonating devices are stored, resulting in a degree of insulation that is adequate, given the restrictions on the quantity and concentration of explosive material in the compartments and the proper choice of corrugated board material as taught herein, to prevent propagation of detonation reactions from one package to another even if the entire contents of any one compartment explode simultaneously.

The packaging system of the present invention further includes overpack pad means such as overpack pad 26*a* of FIG. 2 and pads 26*a* and 26*b* of FIG. 3A. These overpack pads are similar in construction to the subpack pads described above and serve both to prevent the subpack assemblies from jostling within the overpack container and to inhibit the energy released from any inadvertently detonated device from traveling from one subpack assembly to an adjacent subpack assembly.

Without wishing to be bound by any particular theory, it is believed that leaving the sixth wall of the compartment partially open and directed toward the side of the subpack container is a preferred embodiment of the present invention because the surrounding enclosure panels and the subpack pad serve to direct the energy of detonation of a detonator therein away from the adjacent compartment. Nevertheless, the wall of the subpack container, exposed via the partially open sixth side of the compartment, inhibits the passage of energy therethrough. Should detonation energy pass through the wall, it is further inhibited by one of (i) the wall of an adjacent subpack container (see FIG. 3A), (ii) an overpack pad, or (iii) the wall of the overpack container. For example, in the embodiment of FIG. 3A, detonation energy penetrating, e.g., subpack assembly 10' toward subpack assembly 10, would be inhibited from entering the adjacent compartment in subpack assembly 10 by (i) the wall of the subpack container of assembly 10, (ii) a side panel of the enclosure defining the compartment in assembly 10' and (iii) the overpack pad 26*a*. On the other hand, energy directed toward another package, e.g., from assembly 10, would be inhibited by (i) the wall of overpack container 24*b*, (ii) the wall of the adjacent overpack container, (iii) the wall of the subpack assembly in the adjacent overpack container and, probably, (iv) a side panel of the enclosure baffle in the adjacent subpack assembly. Tests have shown that these impediments are effective to prevent propagation of detonation reactions from one package to another, even when the contents of a compartment detonate substantially simultaneously. However, the use of an enclosure baffle to provide an open-sided compartment should not be construed to be a necessary limitation on the invention.

As stated above, the materials used to produce the subpack containers, enclosures or other divider means, subpack pads, overpack containers and optional overpack pads may be made from any suitable corrugated board. The subpack container and the overpack container meet the performance criteria of specification 4G for corrugated containers. Suitable fiberboard products meeting these criteria are available from the Longview Fibre Company of Springfield, Mass. In a particular embodiment of the present invention, the subpack container was dimensioned and configured to define a rectangular box having a length of about 16.6 inches (42.16 cm), a width of about 8.35 inches (21.21 cm) and a height of about 8.25 inches (20.95 cm) and was made from a B-flute fiberboard having a bursting strength of 200 lbs/in$^2$ and a combined minimum facings weight of 84 lbs/m.sq.ft. Enclosures 14 and 16 were made from double-wall (B-flute and C-flute) corrugated board. The subpack pad 18 was made from the same corrugated board as the enclosures, but was folded over to double its thickness. Alternatively, the subpack pad may be made from a triple-wall C-flute corrugated board. The overpack container was made from a C-flute corrugated board reported to have a bursting test strength of 275 lbs/in$^2$ and a minimum combined facings weight of 138 lbs/m.sq.ft. A suitable overpack pad was formed from the same material as the subpack pad, and was similarly folded over to double its thickness. Those skilled in the art will recognize that some variations in the materials selected for the subpack container, enclosure baffles and pads and overpack container may be made without departing from the invention, and that the limits of such variations, given the disclosure herein, can be ascertained without undue experimentation.

In choosing the dimension of the subpack container, certain presumptions must be made with respect to the quantity of explosive in each detonating device to be packaged and the length of shock tube attached thereto, because both factors determine the maximum number of units that can be disposed in the compartment. The quantity of explosive in each unit is important because the subpack container may be inadequate to contain the detonation of even a single device if the quantity of explosive material therein is excessive, and because larger charges are expected to cause other devices in the compartment to detonate, presenting a propagation problem. The length of shock tube also affects the number of units that can be disposed in the compartment, because of its bulk and the great variations in length that can accompany detonator caps, e.g., from 8 to 60 feet. For example, a subpack container dimensioned and configured to have compartments capable of holding up to thirty-five detonating devices each having twenty feet of associated shock tube may be considered to be oversized with respect to detonator caps comprising 800 mg of explosive material per device; a fewer number of such devices would be packed together to assure limited propagation under Special Provision 103, so a smaller sized compartment would be used. Yet, the same compartment may be considered to be undersized with respect to similar devices having 60 feet of shock tube per unit, the bulk of the longer shock tube requiring more space in the container and therefore filling the container before the permitted number of detonator caps is disposed therein. Similarly, the container would be undersized with respect to devices comprising thirty feet of shock tube and a detonator cap comprising only 300 mg of explosive material each; a greater number of unsegregated units could be disposed together than the compartment could accommodate, due to the lesser quantity of explosive material in each unit. The dimensions for the subpack container given above are considered to be adequate to produce a 1.4 B package for commercially useful quantities of detonating devices that may comprise from 8 to 60 feet of shock tube and from about 190 mg ±20 mg to about 745 mg ±50 mg of explosive material per unit (not counting the shock tube core material for reasons discussed below). When the length of shock tube or the relatively low quantities of explosive material per detonating device allow, the subpack pad and divider means may be omitted from the subpack assembly; the detonating devices may be placed directly in the undivided subpack container, provided that the overpack pads are placed between adjacent subpack containers in the overpack container. While the compartment may be viewed as undersized with respect to the smaller of these detonators (190 mg), it performs adequately for the more powerful of them (745 mg) and therefore can be used with confidence for a wide range of products of smaller detonator charges. Should the more powerful detonator units (745 mg ±50 mg each) have shorter associated shock tubes, there may be empty space in the compartment once the maximum number of units is placed therein. Rather than placing additional units in the compartment and risking a violation of 1.4 B restrictions, the remaining volume should be filled with inert dunnage. Thus, it is seen that the dimensions for the subpack container given above allow for the creation of compartments that contain the greatest number of the most powerful allowed detonator caps having the longest commercially desirable length of shock tube.

To illustrate how the maximum allowable number of units of detonating devices may be disposed in a compartment, consider a device produced by The Ensign-Bickford Company under the trade designation EZ Det®, which comprises a length of shock tube having a so-called microcap at one end comprising about 190 mg ±20 mg of dextrinated lead azide and a detonating cap at the other end comprising 95 mg ±10 mg of dextrinated lead azide for initiating a detonating charge of 460 mg ±20 mg PETN. Assuming that the microcap and the detonator cap each have their maximum quantities of explosive materials, the maximum total explosive material in an EZ Det® device is about 795 mg, i.e., about 800 mg. The term "explosive material" as used herein and in the claims is intended to include any material suitable for use in detonator caps for blasting purposes, including PETN, dextrinated lead azide and the like. The shock tube may vary in length, e.g., from 8 60 feet (i.e., between about 2.4 and 18.4 meters) and may contain a mixture of HMX and aluminum in an amount of only about 0.016 grams per meter, for a total maximum contribution of less than 1 gram of explosive material. Shock tube is known to survive the detonation of the explosive material it contains because the linear density of the explosive material is so low, so the explosive material in shock tube is not included in the limitations regarding explosive material per detonating device or the total per container for purposes of the present invention.

Due to the strength, i.e., the relatively large quantity of explosive material in the detonator cap of an EZ Det® device, the detonation of any one device sets off other devices in the same compartment. Therefore, to satisfy the limited propagation requirement of Special Provision 103 the maximum number of EZ Det® units that can be disposed in the same compartment under a 1.4 B classification is about 25 g/0.800 = about 31 units. In practice, each compartment is limited to 30 units, because the then fully packaged container will hold a commercially convenient quantity of units.

Figure 4:
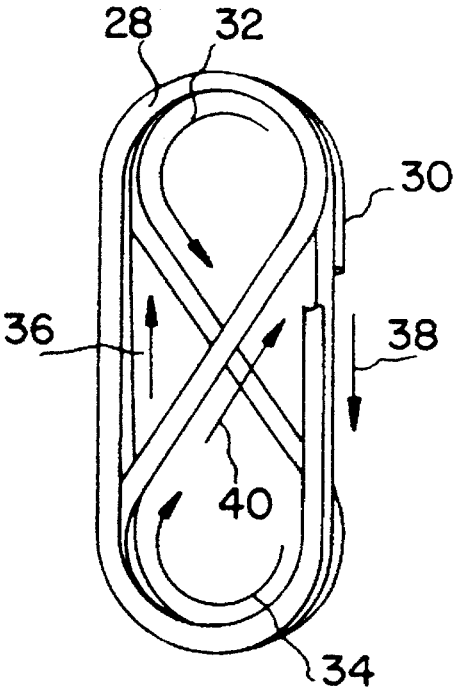
FIG. 4 is a schematic plan view of a shock tube, illustrating a figure of 80 coiling pattern.
Figure 5:
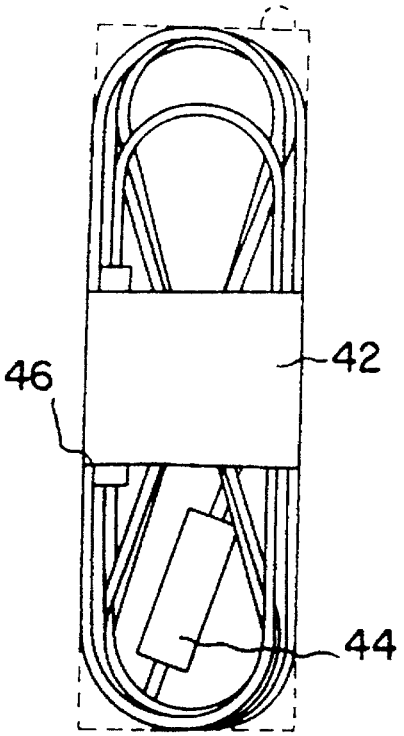
FIG. 5 is a schematic plan view of a detonating device comprising a shock tube coiled in a figure of 80 pattern.

When shipping detonating devices comprising detonator caps and associated lengths of shock tube in a packaging system according to the present invention, it is preferred to wind the shock tube in a "figure of 80" pattern as described in U.S. Pat. No. 5,129,514 to Lilley, Jr. dated Jul. 14, 1992, the disclosure of which is hereby incorporated by reference. To briefly summarize the teaching of the Lilley, Jr. Patent, a figure of 80 configuration may be achieved by choosing one end of a shock tube 28, FIG. 4, as the starting end 30 and establishing an S-shape by disposing shock tube 28 in the directions indicated by arrows 32 and 34. A length of the tube may continue straight up (as sensed in FIG. 4) as shown by arrow 36 and may then wind around the top of the S and straight down as indicated by arrow 38, completing the "0" of the "80". The shock tube 28 is then disposed along the bottom of the S, and then traverses the S as indicated by arrow 40 to establish a FIG. 8 within the encircling FIG. 0, thus creating the figure of 80 pattern. For ease of illustration, the detonator cap associated with shock tube 28 is not shown in FIG. 4. When the winding is complete, a single frangible band, e.g., paper packaging tape 42, FIG. 5, may be used to secure the figure of 80 pattern in place. Alternatively, the frangible band may be used to secure together a plurality of detonating devices each comprising a length of shock tube coiled in a figure of 80 pattern. In the embodiment of FIG. 5, the detonating device comprises a detonator cap 44 at one end and a so-called microcap 46 at the other end. As can be seen in FIG. 5, the detonator cap 44, which comprises the largest proportion of explosive material in the device, is disposed at the lower end of the figure of 80 pattern, while the microcap is disposed near the middle of the coil. When the figure of 80 winding is used in such products, it is preferred to alternate the position of the detonator caps between adjacent detonating devices so that they are not in close proximity in which detonator caps 44*a*, 44*b*, etc. of adjacent detonating devices as represented in FIG. 5 are disposed at opposite ends of the compartments defined by subpack assemblies 10 and 10', and so that the shock tube windings of one device are disposed next to the detonator cap of the other device to act as dunnage for its adjacent detonator cap to inhibit the energy that may be released from that cap upon accidental detonation.

In addition to the foregoing, it is optional but preferred to place the subpack assemblies in a sealed moisture barrier bag in the overpack container. The barrier bag may be made from polymer-metal foil laminate material, with a dessicant, to absorb moisture that may enter the packaging system over long-term storage and affect the performance of the detonating devices therein.

EXAMPLE 1

A detonator package according to the present invention was prepared using an EZ Det® device as described above. Thirty EZ Det® devices were disposed in each of two compartments in a subpack assembly, and three such subpack assemblies were disposed in an overpack container measuring 27 inches X 17.5 inches X 9.5 inches. The subpack container material comprised a B-flute board having a bursting strength of 200 lbs/in$^2$ as described above; the overpack container material comprised a C-flute board having a bursting strength of 275 lbs/in$^2$. Three such packages were prepared so that the test could be repeated in three trials.

In each trial, a complete package of detonators was placed on a steel witness plate and a detonator near the center of the package was primed. The package was surrounded with corrugated board containers of loose sand to provide 0.5 meters of confining material in all directions in compliance with the 6(*a*) test set forth in the Explosive Test Manual. The primed detonator was set off and the degree of propagation in the package and extensive damage to the confining material and to the witness plate were observed. In each trial, there was no damage to the witness plate beneath the package, no crater at the test site, no explosion of the package, and no disruption or scattering of the confining material. Further, propagation of the detonation was limited to the compartment in which the primed detonator was located.

EXAMPLE 2

The tests described in Example 1 were repeated, except that the detonating devices were the EZTL™ products. The results were the same as in Example 1, except that only the primed detonator fired; there was no propagation within the package.

EXAMPLE 3

Packages prepared in accordance with Examples 1 and 2 were subjected to a 12 meter drop test in which three packages of each were dropped from a height of 12 meters onto their end, side and bottom, respectively. The packages were observed for damage to the package and resulting reaction by the detonating devices. No damage was observed when the packages were dropped on their side or bottom; minimal damage occurred to packages of both products when dropped on end. There was no fire or explosion resulting in any of the trials.

EXAMPLE 4

Three complete packages containing 180 units each of the EZ Det® product were prepared as described in Example 1 and were subjected to an external fire test pursuant to test 6(*c*) of the Explosive Test Manual. The packages were arranged in a steel stand and encircled with steel banding for support. Sufficient diesel fuel was poured into a receptacle beneath the stand. The fuel was ignited using black powder and electric matches. No explosion, no hazardous projections (i.e., escaping energy) and no significant thermal effects were observed in any of the three packages.

Comparative Example 1

Figure 6:
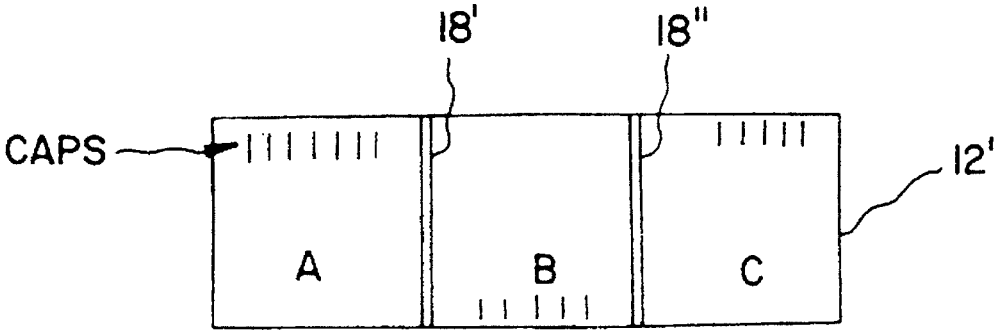
FIG. 6 is a schematic plan view of a packaging assembly of a comparative example of a subpack container and subpack pads without divider means.
Figure 7:
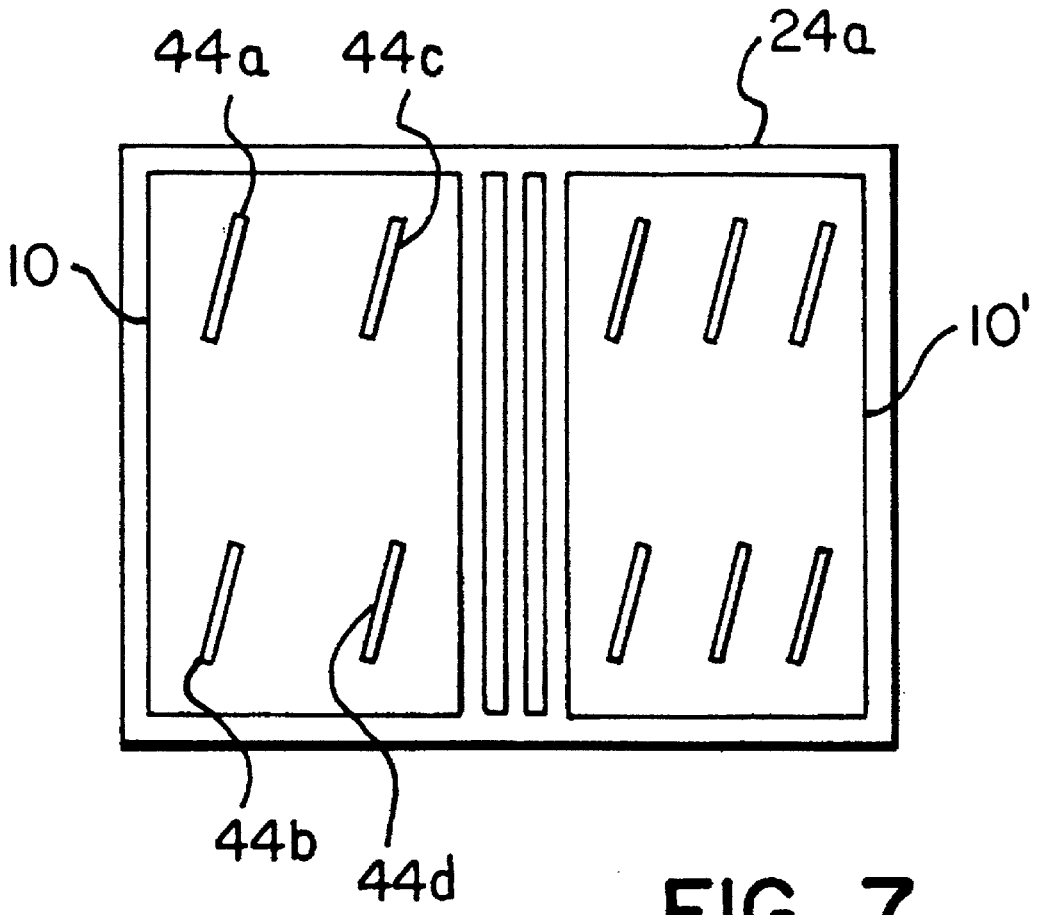
FIG. 7 is a schematic view of the packaging system of FIG. 2, showing the positions of detonator caps of adjacent detonating devices at opposite ends of the compartments.

A subpack container 12' as described above was divided into three sections A, B and C using two pads 18', 18" but without using divider means such as compartment boxes or enclosures, as illustrated in FIG. 6. Thirty units of the MS™ product each comprising a length of shock tube and a detonator cap having a maximum explosive weight of 585 mg were disposed in each section, with all the caps in each section disposed at the same side of the container; the caps in the middle section were disposed on a side opposite to the caps on the end sections, as illustrated in FIG. 6. The subpack container was disposed on a witness plate and surrounded with confinement materials (containers of sand). A detonator cap in the middle section was primed and fired. After firing, it was found that the detonation propagated entirely within the central section and through the pads to the adjacent sections, so that all the units in the subpack container fired. The witness plate showed 3 or 4 dents each about 1 inch in diameter. Since the total amount of explosive material that detonated was greater than 25 g and because damage was observed on the witness plate, this configuration was deemed not to be acceptable.

Comparative Example 2

A package was prepared as described in Comparative Example 1, except that four sections in the box were defined by the use of three pads, without the use of compartment boxes or enclosures and a total of 100 units were disposed in the subpack container, with 25 units in each section. The package was tested in the same manner as in Comparative Example 1. Upon detonation of a single, primed unit, the detonation propagated to all 100 units in the subpack container, and damage was caused to the witness plate.

Comparative Example 3

Three subpack containers were prepared and packaged as described in Comparative Example 1 and were disposed in an overpack container. Overpack pads were disposed between the subpack containers. In this comparative example, all the caps in each subpack container were disposed on the same side of the subpack container, and the subpack containers were disposed in the overpack container so that the detonator caps were proximate to the outer wall of the overpack container. A unit near the center of one subpack container was primed and fired. Eighty-eight of the 90 units in the test subpack container fired as well, showing that the detonation propagated through the pads within the subpack container. However, there was no propagation of the detonation from one subpack container to another through the overpack pads.

Comparative Example 4

Three subpack containers were packaged as described above in Comparative Example 1, and the three subpack containers were disposed in an overpack container. No subpack divider means, i.e., no enclosure boxes or baffles, and no overpack pads were used. Upon firing of a single test unit, no damage was caused to the witness plate, although the detonation propagated through the subpack pads to all 90 units in the subpack container causing a detonation of more than 25 g of explosive material.

While the invention has been described in detail with reference to particular embodiments thereof, and while certain features of the invention may have been illustrated in some embodiments of the invention and not in others, this is not intended as a limitation of the invention, and it will be apparent that upon a reading and understanding of the foregoing, numerous alterations to the described embodiments will occur to those skilled in the art and it is intended to include such alterations within the scope of the appended claims.

What is claimed is:

1. A packaging system for storing and transporting detonating devices, comprising:

at least one subpack assembly comprising a subpack container having enclosed therein a plurality of divider means each defining a compartment, to provide a plurality of compartments in the subpack container, each compartment being dimensioned and configured to contain a plurality of unsegregated detonating devices, and further comprising subpack pad means disposed between adjacent compartments in each subpack container for inhibiting the transfer of energy generated by detonation of one or more detonating devices in one compartment to the adjacent compartment; and an overpack container within which is disposed the at least one subpack container;

wherein the subpack assembly and the overpack container comprise 4G corrugated board containers;

wherein the subpack container has a bursting strength of at least about 200 lbs/in$^2$ and the overpack container comprises corrugated board having a bursting strength of at least about 275 lbs/in$^2$, the subpack pad means and the corrugated board of the subpack container and of the overpack container having sufficient strength to prevent the propagation of the detonation of not more than about 25 grams of explosive material in any one of the compartments to another compartment; and wherein each divider means comprises a closed box defining one of said compartments.

2. The packaging system of claim 1 further comprising a plurality of devices in each compartment, each plurality of detonating devices comprising a total of not more than about 25 grams of explosive material, whereby detonation of the devices in one compartment does not propagate to another compartment.

3. The packaging system of claim 2 wherein adjacent detonating devices are disposed with their respective detonator caps at respective opposite sides of the compartment within which they are disposed.

4. A packaging system for storing and transporting detonating devices, comprising:

a plurality of subpack assemblies each comprising a subpack container comprising corrugated board having a bursting strength of at least 200 lbs/in$^2$ and having disposed therein divider means comprising double-wall B- and C-flute or stronger corrugated board and defining a plurality of compartments of the subpack assembly, each compartment being dimensioned and configured to contain a plurality of unsegregated detonating devices, the subpack assembly further comprising subpack pad means comprising a double layer of double-wall B- and C-flute or stronger corrugated board and being disposed between adjacent compartments for inhibiting the transfer of energy generated by detonation of one or more detonators in one compartment to the adjacent compartment; and an overpack container comprising corrugated board having a bursting strength of at least 275 lbs/in$^2$ and within which the subpack assemblies are disposed.

5. The packaging system of claim 4 further comprising overpack pad means comprising double-wall B- and C-flute or stronger corrugated board disposed in the overpack container between adjacent subpack assemblies for inhibiting the transfer of energy generated by detonation of one or more detonators in one subpack assembly to the adjacent subpack assembly.

6. The packaging system of claim 4 wherein the divider means comprises a plurality of compartment boxes, each compartment box being dimensioned and configured to define one of said compartments.

7. The packaging system of claim 6 further comprising a plurality of detonating devices in each compartment, each plurality of detonating devices comprising a total of not more than about 25 grams of explosive material exclusive of any explosive material in the shock tube, whereby detonation of the devices in one compartment will not propagate to another compartment.

8. The packaging system of claim 7 further comprising a plurality of detonating devices in each compartment and wherein each detonating device individually comprises a length of shock tube and one or two detonating caps attached to the shock tube, the detonator caps containing not more than about 800 mg of explosive material per device, exclusive of the material in the core of the shock tube.

9. The packaging system of claim 7 wherein adjacent detonating devices are disposed with their respective detonator caps at respective opposite sides of the compartment within which they are disposed.

* * * * *

UNITED STATES PATENT AND TRADEMARK OFFICE

CERTIFICATE OF CORRECTION

PATENT NO. : 5,494,152

DATED : February 27, 1996

INVENTOR(S) : Brian R. Sobczak et al

It is certified that error appears in the above-indentified patent and that said Letters Patent is hereby corrected as shown below:

In column 5, line 25, replace "vider" with --divider--;
line 55, after "means" insert --are--.

In column 9, line 30, replace "8 60" with --8 to 60--.

In claim 1, column 12, line 60, insert a comma after "200 lbs/in$^2$".

In claim 6, column 14, line 8, after "of claim 4", insert --or claim 5--.

Signed and Sealed this

Third Day of September, 1996

*Attest:*

Bruce Lehman

BRUCE LEHMAN

*Attesting Officer*

*Commissioner of Patents and Trademarks*